United States Patent [19]

Whitfield et al.

[11] 4,432,834

[45] Feb. 21, 1984

[54] ADDITIVE FOR FELTED CELLULOSE FIBERS

[75] Inventors: Joyce M. Whitfield, Chicago; David R. Cosper, Downers Grove, both of Ill.

[73] Assignee: Nalco Chemical Company, Oak Brook, Ill.

[21] Appl. No.: 139,176

[22] Filed: Apr. 11, 1980

Related U.S. Application Data

[63] Continuation of Ser. No. 954,478, Oct. 25, 1978, abandoned.

[51] Int. Cl.[3] ..... D21H 3/12

[52] U.S. Cl. ..... 162/158; 162/168.2; 162/168.5; 252/8.8

[58] Field of Search ..... 162/158, 168 N, 164 R, 162/111, 112, 179, 168.2, 168.5, 164.6; 427/391, 395; 252/8.8 AJ, 8.8 Ac, 8.8 R; 260/29.6 N

[56] References Cited

U.S. PATENT DOCUMENTS

| | | | |
|---|---|---|---|
| 3,288,770 | 11/1966 | Butler | 526/204 |
| 3,681,241 | 8/1972 | Rudy | 252/8.8 R |
| 3,956,556 | 5/1976 | McQueary | 428/131 |

*Primary Examiner*—Peter Chin

*Attorney, Agent, or Firm*—Richard L. Johnston

[57] ABSTRACT

A composition is provided for addition to cellulosic fibers prior to felting them into a sheet comprising as component (a) a monomeric water soluble diallyl dimethyl ammonium halide or homopolymer thereof or mixtures thereof and as component (b) a water dispersible complex fatty amido compound, the proportion of (a) and (b) being sufficient to enhance softness of the dried sheet while increasing or not substantially reducing absorbency of water and tensile strength.

13 Claims, No Drawings

ADDITIVE FOR FELTED CELLULOSE FIBERS

This is a continuation of application Ser. No. 954,478, filed Oct. 25, 1978 now abandoned.

BACKGROUND

In recent years the tissue and toweling industry has become very conscious of the consumer's desire for "soft" products. This desire is particularly evident with respect to certain brands of toilet tissue which are made from felted cellulosic fibers where softness is achieved by a mechanical process.

Tissue and toweling, by their nature, must be very absorbent because they are designed to take up water quickly and to hold it. Any product which is used to soften tissue must not interfere with the basic absorbency and preferably should not unduly reduce the tensile strength.

It would be desirable to provide a chemical additive composition which can be added to cellulosic fibers prior to forming them into a sheet and which would enhance the softness of the resultant dried product while increasing or not substantially reducing the absorbency of water and tensile strength.

OBJECTS

One of the objects of the present invention is to provide such an additive.

Another object of this invention is to provide an additive of the type described containing two or more components which are compatible with one another and which can be added to cellulosic fibers such as paper pulp just ahead of the wet end of a paper forming apparatus, preferably before the pump which pumps the pulp mixture into a machine chest.

Other objects of the invention are to provide additives of the type described which do not interfere with color or whiteness, do not cause foam during processing, are competitive costwise, and satisfy pertinent toxicity limitations.

Other objects will appear from the following description.

BRIEF SUMMARY OF THE INVENTION

In accordance with the invention a composition is provided for addition to cellulosic fibers prior to felting them into a sheet comprising as component (a) a monomeric water soluble diallyl dimethyl ammonium halide or homopolymer thereof or mixtures thereof and as component (b) a water dispersible complex fatty amido compound the proportion of (a) and (b) being sufficient to enhance softness of the dried sheet while increasing or not substantially reducing absorbency of water and tensile strength.

DETAILED DESCRIPTION OF THE INVENTION

In evaluating the invention various chemicals were evaluated individually by adding them to a thick paper pulp stock followed by mechanical mixing for three minutes. The thick stock was then diluted and handsheets were made.

A Noble and Wood handsheet machine was used to make the handsheets. A handsheet weight of 1.25 grams was selected in order to evaluate the effect of additives on "tissue-like" handsheets. Standard procedures for making handsheets were experimented with until a procedure for making tissue-like handsheets could be achieved. Because these handsheets are so thin, care must be taken to prevent any variations in a handsheet. Voids, flow marks, creases, and thin spots in a handsheet could introduce a variable which might not be recognized so only perfect handsheets were tested. To make a perfect 1.25 gram tissue handsheet the following steps were employed:

1. mixing in a headbox so as to allow dilution of the paper slurry but not to cause turbulence;
2. passing the handsheets through a roller press with no weight applied by the rollers;
3. drying by passing the handsheets through a drum dryer twice, first blotter side on the drum, then removing the tissue from the blotter and passing it through the dryer alone. Care was taken to avoid creases in the handsheet when it passed through the dryer alone.

The handsheets were conditioned at least 24 hours in a controlled temperature (72° F.) and humidity (50%) room before any testing was done. The effect of the treatments was measured by changes of absorbency, sheet strength and softness in the treated handsheet as compared to an untreated handsheet.

The absorbency of the handsheets was measured by a modification of TAPPI standard 492. Twenty microliters of distilled water at 72° F. was placed on the surface of the test sheet by a 20 microliter Eppendorf Pipette. The time taken for the water to be absorbed is measured with a stopwatch. This is made easier by placing a light source in such a position that the light causes a glare on the surface of the water. When the water is absorbed, the glare disappears.

Sheet strength was measured on the Twing-Albert Hydro-Hydraulic Tensile Tester with all the weights removed. Sheet strength is the average stress necessary to pull apart a 1 inch wide strip of tissue handsheet.

The softness of a treated handsheet cannot be measure by instrumentation. The Hand-O-Meter, the Gurley Hill S-P-S Tester and the Friction Meter, test properties other than softness and none of these methods are widely accepted by tissue mill personnel. Softness was judged by a panel of volunteers.

All products selected for testing were evaluated at a dosage level of 1% based on dry fiber. In preliminary tests products were evaluated according to whether they were amphoteric, nonionic, or cationic. In general, as a result of this evaluation, quaternary compounds which are cationic appeared to afford the best possibilities from the standpoint of absorbency and sheet strength but no general conclusions could be drawn because some quaternary compounds gave good absorbency but very poor sheet strength. Included in this group were a number of imidazoline quaternaries. Many compounds containing long carbon chains which were effective to produce softness gave very poor sheet strength. Thus, the compound 1-stearamidoethyl-1-methyl-2-heptadecyl imidazolinium methosulfate which is an imidazoline quaternary, gave an absorbency of 243% of the blank but a sheet strength of less than 1% of the blank. On the other hand, this compound had the advantage that it was easily dispersed in water, was non-toxic and non-irritating.

A second series of testing was therefore carried out using a water dispersible complex fatty amido compound, namely, 1-stearamidoethyl-1-methyl-2-heptadecyl imidazolinium methosulfate and a second component or a plurality of components which, in combination with the water dispersible complex fatty amido compound, in predetermined proportions, would enhance softness of the dried sheet while increasing or not substantially reducing absorbency of water and tensile strength. This series of testing was carried out at a dosage level of 0.15% based on dry fiber, by adding the proper concentration of the two components separately. This eliminated the need to formulate the two components into one product but also caused a later problem, in that one particular treatment combination showed great possibilities when the components were added independently of each other but a formulation of the two could not be achieved.

As a result of this second series of tests it was found that a water dispersible complex fatty amido compound such as 1-stearamidoethyl-1-methyl-2-heptadecyl imidazolinium methosulfate when combined with a monomeric water soluble diallyl dimethyl ammonium halide or homopolymer thereof or mixture thereof would enhance softness of the dried sheet while increasing or not substantially reducing absorbency of water and tensile strength.

The 1-stearamidoethyl-1-methyl-2-heptadecyl imidazolinium methosulfate alone gave absorbency but reduced sheet strength and was not judged soft. The monomeric diallyl dimethyl ammonium halide improved sheet strength. The homopolymer softened tissue, improved sheet strength and reduced absorbency. Various combinations of these components improved absorbency and sheet strength and were judged soft. Other combinations were judged soft while their absorbency and sheet strength were maintained at the pretreatment level.

The invention will be further illustrated but is not limited by the following examples in which the parts are by weight unless otherwise indicated.

EXAMPLE I

A composition was prepared by blending 75 parts by weight of monomeric diallyl dimethyl ammonium chloride (hereinafter referred to as ingredient (a) with 25 parts by weight of 2-stearamidoethyl-1-methyl-2-heptadecyl imidazolinium methosulfate (hereinafter referred to as ingredient (b).

Tissue sheets were prepared by incorporating said composition at various dosages and comparing them with blanks containing no additive as well as blanks containing the individual additives.

The resultant tissue sheets were then evaluated in the manner previously described for absorbency, strength and softness.

The composition of the invention containing the two aforementioned components in a weight ratio of 3:1 at a dosage of 2.3 pounds per ton (0.115% by weight) based on the weight of the dried sheet gave an absorbency of 85% of the blank and a strength of 117% of the blank and was judged to be soft. In comparison, a composition composed solely of ingredient (a) was incorporated into a tissue sheet in the manner previously described at a dosage of 2.7 pounds per ton (0.135% by weight). The resultant tissue sheet had an absorbency of 101% of the blank and a strength of 166% of the blank but was not soft. Similarly, ingredient (b) alone at a dosage of 1.6 pound per ton (0.08% by weight) gave a tissue sheet which had an absorbency of 105% of the blank and a strength of 121% of the blank but was not soft. Smaller dosages of the individual ingredients produced tissue sheets which had approximately the same absorbency and lower tensile strengths. Smaller dosages of the combined ingredients gave about the same absorbencies and slightly different tensile strengths but were not judged to be soft.

EXAMPLE II

The procedure was the same as in Example I except that ingredient (a) and ingredient (b) were mixed with water in proportions of 10 parts of ingredient (a), 30 parts of ingredient (b) and 60 parts of water. The resultant composition when incorporated into the tissue sheets at a dosage level of 0.9 pounds per ton (0.045% by weight) gave an absorbency of 95% of the absorbency of the blank, a strength of 102% of the strength of the blank, and was judged to be soft. A dosage of 1.8 pounds per ton gave an absorbency of 96% of the blank and a strength of 120% of the blank and the resultant tissue sheet was judged to be soft. A dosage of 3.5 pounds per ton gave an absorbency of 99% of the blank, a strength of 100% of the blank and was judged to be soft.

EXAMPLE III

A composition was prepared by dissolving 12 parts of a homopolymer of ingredient (a) having an intrinsic viscosity of 0.3 to 0.4, 38 parts of ingredient (b) in 50 parts of water. This composition gave an absorbency to the tissue sheet at a dosage of 3.1 pound per ton (0.155% by weight) of 99% of the blank, a strength of 98% of the blank and was judged to be soft.

EXAMPLE IV

A composition was prepared by dissolving 15 parts of ingredient (a), 15 parts of a homopolymer of ingredient (a) having an intrinsic viscosity of 0.3 to 0.4 and 30 parts of ingredient (b) in 40 parts of water. The resultant composition was then used in making tissue sheets in the manner previously described at various dosages. At a dosage of 0.8 pound per ton (0.04% by weight) the absorbency was 96% of the blank, the strength was 92% of the blank and the product was judged to be soft. At a dosage of 1.50 pounds per ton (0.075% by weight) the absorbency of the tissue sheet was 91% of the blank, the strength was 92% of the blank and the product was judged to be soft. At a dosage of 3.0 pounds per ton (0.15% by weight), the absorbency was 99% of the blank, the strength 86% of the blank, and the product was judged to be soft.

EXAMPLE V

A composition was prepared by dissolving 10 parts by weight of ingredient (a) and 30 parts by weight of a complex fatty amido compound known as SOROMINE AT in 60 parts of water. The resultant composition when used in making tissue sheets in the manner previously described at a dosage of 2 pounds per ton (0.1% by weight) gave an absorbency of 85% of the blank, the strength of 94% of the blank and was judged to be soft.

EXAMPLE VI

A composition containing 10 parts ingredient (a) and 30 parts ingredient (b) dissolved in 60 parts of water was incorporated into a tissue sheet in a manner previously described at a dosage of 2 pounds per ton (0.1% by weight) and gave an absorbency of 96% of the blank and the strength of 120% of the blank and was judged to be soft.

In general, the compositions of the invention comprise as component (a) a monomeric water soluble diallyl dimethyl ammonium halide in which the halide portion of the molecule can be fluorine, chlorine, bromine, or iodine, but is preferably chlorine or a homopolymer thereof which preferably has an intrinsic viscosity of 0.3 to 0.4 but can have a higher intrinsic viscosity, for example, 0.7 or higher so long as it is water soluble or water dispersible, or mixtures of the monomer and homopolymers. Ingredient (a) is essentially a quaternary salt in which all of the hydrocarbon groups attached to the quaternary nitrogen atom are lower hydrocarbon groups containing not more than four carbon atoms and at least two of such groups are allyl groups in the monomer. In the polymer the allyl groups are cross linked to produce linear polymers containing a plurality of quaternary ammonium groups. The molecular weights of these polymers, as evidenced by the intrinsic viscosities, are generally low ranging from several thousand to as much as 50,000. The monomers and the polymers are all known in the art.

The second component of the composition which is herein referred to as ingredient (b) is characterized by the fact that it contains one or more long chains including an amido group in which a hydrocarbon long chain containing 8–18 carbon atoms is linked to the amido nitrogen. The imidazolines, and more particularly the quaternized imidazolinium compounds such as 1-stearamidoethyl-1-methyl-2-heptadecyl imidazolinium quaternary salts and especially the methosulfate, are especially useful for the purpose of the invention. These compounds are also well known in the prior art.

The invention resides in the discovery that compositions consisting essentially of components (a) and (b), preferably within weight ratios of 4:1 to 1:4 and especially within the range of 3:1 to 1:3, or in the case of compositions containing monomeric and polymeric diallyl dimethyl ammonium chloride in the range of 1:1:3, are particularly useful for the purpose of the invention. These compositions are preferably added to aqueous slurries of cellulosic fibers such as paper pulp slurries prior to felting them into a sheet, the addition preferably being made just ahead of the wet end of a paper-forming apparatus, for example, before the pump which pumps the pulp mixture into a machine chest. The dosages used should be sufficient to enhance softness of the dried sheet while increasing or not substantially reducing absorbency of water and tensile strength. While the dosages may vary depending upon the specific composition of the additive, effective results have been obtained at dosages as low as 0.04% by weight of the additive composition, based on the dried weight of the felted sheet. In general, the dosage might vary from 0.01% to 0.4% with the best results being obtained between 0.1% and 0.2% by weight of the additive based on the dried weight of the cellulosic sheet.

The invention is hereby claimed as follows:

1. A composition suitable for addition to cellulosic fibers prior to felting them into a tissue sheet comprising as component (a) a monomeric water soluble diallyl dimethyl ammonium halide or homopolymer thereof or mixtures thereof and as component (b) 1-stearamidoethyl-1-methyl-2-heptadecyl imidazolinium methosulfate, the proportions of (a) and (b) being sufficient to enhance softness of the dried sheet while increasing or not substantially reducing absorbency of water and tensile strength of the dried sheet when said composition is added to a slurry of cellulosic fibers prior to felting them into a sheet and thereafter drying said sheet, the weight ratio of component (a) to component (b) in said composition being within the range of 4:1 to 1:4.

2. A composition as claimed in claim 1 wherein said component (a) is monomeric diallyl dimethyl ammonium chloride and component (b) is 1-stearamidoethyl-1-methyl-2-heptadecyl imidazolinium methosulfate.

3. A composition as claimed in claim 1 wherein said component (a) is polymeric diallyl dimethyl ammonium chloride and component (b) is 1-stearamidoethyl-1-methyl-2-heptadecyl imidazolinium methosulfate.

4. A composition as claimed in claim 1 wherein said component (a) is a mixture of monomeric and polymeric diallyl dimethyl ammonium chloride and component (b) is 1-stearamidoethyl-1-methyl-2-heptadecyl imidazolinium methosulfate.

5. A composition as claimed in claim 2 in which the weight ratio of component (a) to component (b) is approximately to 1:3.

6. A composition as claimed in claim 3 in which the weight ratio of component (a) to component (b) is approximately 1:3.

7. A composition as claimed in claim 4 in which the weight ratio of said monomeric and polymeric diallyl dimethyl ammonium chloride and of said component (b) is approximately 1:1:3.

8. A composition as claimed in claim 1 in which said components (a) and (b) are dissolved in water.

9. A dried felted cellulosic fiber tissue sheet containing an amount of a composition comprising as component (a) a monomeric water soluble diallyl dimethyl ammonium halide or homopolymer thereof or mixtures thereof and as component (b) 1-stearamidoethyl-1-methyl-2-heptadecyl imidazolinium methosulfate, the proportions of (a) and (b) and said amount being sufficient to enhance softness while increasing or not substantially reducing water absorbency and tensile strength of the dried sheet as compared with a dried felted cellulosic tissue fiber sheet to which said composition has not been added.

10. A sheet as claimed in claim 9 in which the amount of said composition is within the range of 0.01% to 1% by weight.

11. A dried felted cellulosic fiber tissue sheet as claimed in claim 9 containing 0.01 to 1% by weight of a composition comprising (a) monomeric diallyl dimethyl ammonium chloride and (b) 1-stearamidoethyl-1-methyl-2-heptadecyl imidazolinium methosulfate in proportions within a weight ratio of (a) to (b) of 4:1 to 1:4 sufficient to enhance softness of the dried sheet while increasing or not substantially reducing absorbency of water and tensile strength of the dried sheet.

12. A dried felted cellulosic fiber tissue sheet as claimed in claim 9 containing 0.01 to 1% by weight of a composition comprising (a) polymeric diallyl dimethyl ammonium chloride and (b) 1-stearamidoethyl-1-methyl-2-heptadecyl imidazolinium methosulfate in proportions within a weight ratio of (a) to (b) of 4:1 to 1:4 sufficient to enhance softness of the dried sheet while increasing or not substantially reducing absorbency of water and tensile strength of the dried sheet.

13. A dried felted cellulosic fiber tissue sheet as claimed in claim 9 containing 0.01 to 1% by weight of a composition comprising (a) a mixture of monomeric and polymeric diallyl dimethyl ammonium chloride and (b) 1-stearamidoethyl-1-methyl-2-heptadecyl imidazolinium methosulfate in proportions within a weight ratio of (a) to (b) of 4:1 to 1:4 sufficient to enhance softness of the dried sheet while increasing or not substantially reducing absorbency of water and tensile strength of the dried sheet.

* * * * *